US007446638B2

(12) United States Patent
Nogi

(10) Patent No.: US 7,446,638 B2
(45) Date of Patent: Nov. 4, 2008

(54) MULTILAYER INDUCTOR

(75) Inventor: Kenichirou Nogi, Gunma (JP)

(73) Assignee: Taiyo Yuden Co., Ltd., Tokyo (JP)

( * ) Notice: Subject to any disclaimer, the term of this patent is extended or adjusted under 35 U.S.C. 154(b) by 31 days.

(21) Appl. No.: 11/633,241

(22) Filed: Dec. 4, 2006

(65) Prior Publication Data

US 2007/0146109 A1 Jun. 28, 2007

(30) Foreign Application Priority Data

Dec. 5, 2005 (JP) ..... 2005-350557

(51) Int. Cl.
*H01F 5/00* (2006.01)

(52) U.S. Cl. ..... 336/200; 336/223; 336/232

(58) Field of Classification Search ..... 336/200, 336/223, 232

See application file for complete search history.

(56) References Cited

U.S. PATENT DOCUMENTS 6,459,351 B1 * 10/2002 Maki et al. ..... 336/200
6,515,568 B1 * 2/2003 Maki et al. ..... 336/200
7,304,557 B2 * 12/2007 Tsuzuki et al. ..... 336/200
2004/0108934 A1 * 6/2004 Choi et al. ..... 336/200

FOREIGN PATENT DOCUMENTS

JP 56-155516 12/1981
JP 2006339532 A * 12/2006

* cited by examiner

*Primary Examiner*—Anh T Mai
(74) *Attorney, Agent, or Firm*—Knobbe Martens Olson & Bear LLP

(57) ABSTRACT

A multilayer inductor includes a plurality of conductor layers for a coil, a plurality of magnetic substance layers, the magnetic substance layers and the conductor layers laminated alternately, and at least a magnetic flux restrictor layer disposed to block magnetic flux passing through the inner region of the coil. The magnetic flux restrictor layer is thinner at the center part of the coil than it is in a region near one of the conductor layers.

6 Claims, 13 Drawing Sheets

MULTILAYER INDUCTOR

BACKGROUND OF THE INVENTION

1. Field of the Invention

The present invention relates to multilayer inductors.

2. Description of the Related Technology

A multilayer inductor with a closed magnetic circuit has a structure in which a plurality of conductor layers for forming a coil, and a plurality of magnetic substance layers are laminated alternately. When a predetermined or higher direct current is applied to the multilayer inductor, an inductance may decrease due to magnetic saturation. The decrease in inductance may be improved by changing the laminated inductor with the closed magnetic circuit into the one with an open magnetic circuit, and more specifically, by arranging a nonmagnetic insulator layer 1*c* between magnetic substance layers 1*b* of a laminated product 1 as shown in FIG. 20. In FIG. 20, a pair of external electrodes 2 and a plurality of conductor layers 1*a* for forming a coil are also illustrated (refer to Japanese Unexamined Patent Application Publication No. 56-155516).

According to the multilayer inductor shown in FIG. 20 with the nonmagnetic insulator layer 1*c* interposed between the magnetic substance layers 1*b*, the magnetic saturation can be suppressed by the nonmagnetic insulator layer 1*c* to improve direct current superposition characteristics. However, magnetic reluctance becomes high even under low magnetic flux density, thereby decreasing an inductance due to the magnetic reluctance.

SUMMARY OF CERTAIN INVENTIVE ASPECTS

In light of the above circumstances, an object of certain inventive aspects is to provide a multilayer inductor that can improve direct current superposition characteristics and prevent excessive decrease in inductance.

To attain the above object, a multilayer inductor according to an aspect of the present invention includes a plurality of conductor layers for a coil, a plurality of magnetic substance layers, the magnetic substance layers and the conductor layers laminated alternately, and at least a magnetic flux restrictor layer disposed to block magnetic flux passing through the inner region of the coil. A thickness of the magnetic flux restrictor layer at the center part of the coil is smaller than a thickness thereof at the vicinity of adjacently disposed one of the conductor layers.

With this inductor, increase in density of magnetic flux is suppressed by the magnetic flux restrictor layer disposed to block the magnetic flux passing through the inner region of the coil, whereby magnetic saturation can be restricted when direct current is applied and thus the direct current superposition characteristics can be improved. In addition, the thickness of the magnetic flux restrictor layer at the center part of the coil is smaller than the thickness thereof at the vicinity of the adjacently disposed one of the conductor layers, whereby it is possible to decrease magnetic reluctance at the center part of the coil having low magnetic flux density, and to restrict decrease in inductance due to the magnetic reluctance.

There may be provided a multilayer inductor that can improve the direct current superposition characteristics and prevent the excessive decrease in inductance.

The above-mentioned object and other objects, features, and advantages of certain inventive aspects will be apparent with reference to the following description and the attached drawings.

DETAILED DESCRIPTION OF CERTAIN EMBODIMENTS

Figure 1:
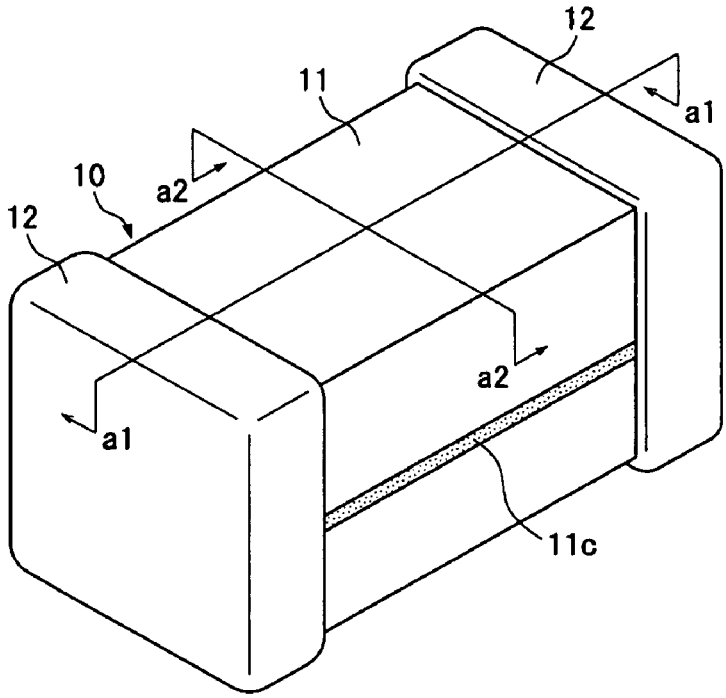
FIG. 1 is a perspective view showing a multilayer inductor according to a first embodiment of the present invention.
Figure 2:
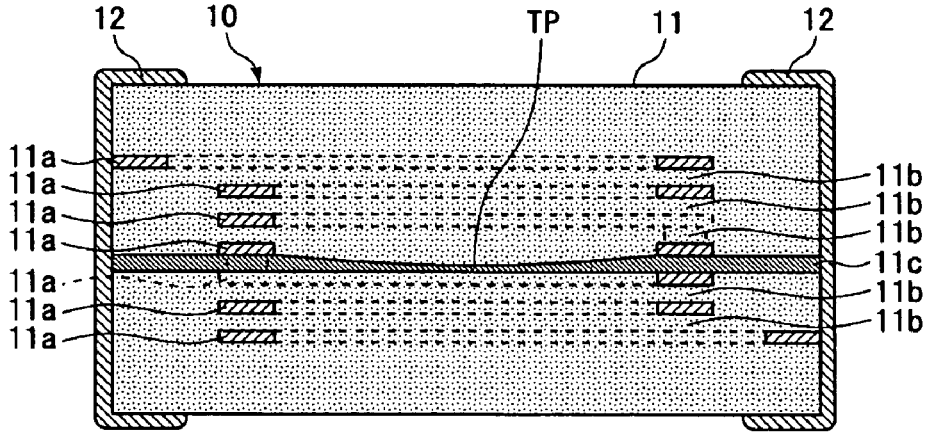
FIG. 2 is a cross section taken along the line a1-a1 shown in FIG. 1.
Figure 3:
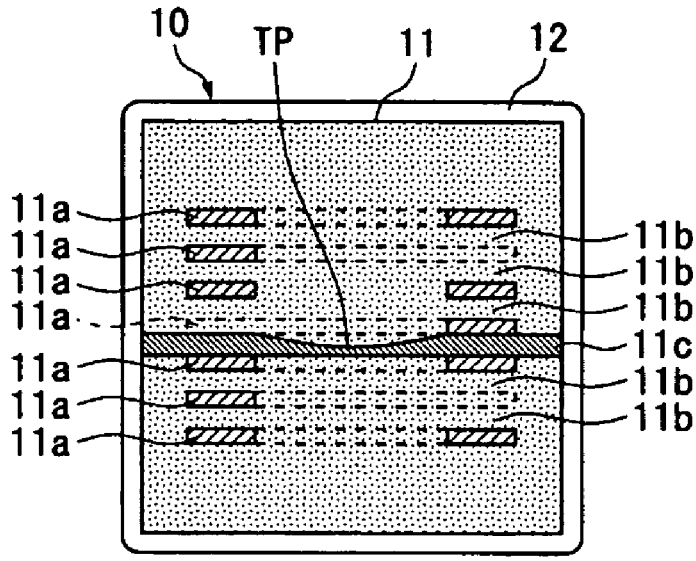
FIG. 3 is a cross section taken along the line a2-a2 shown in FIG. 1.
Figure 4:
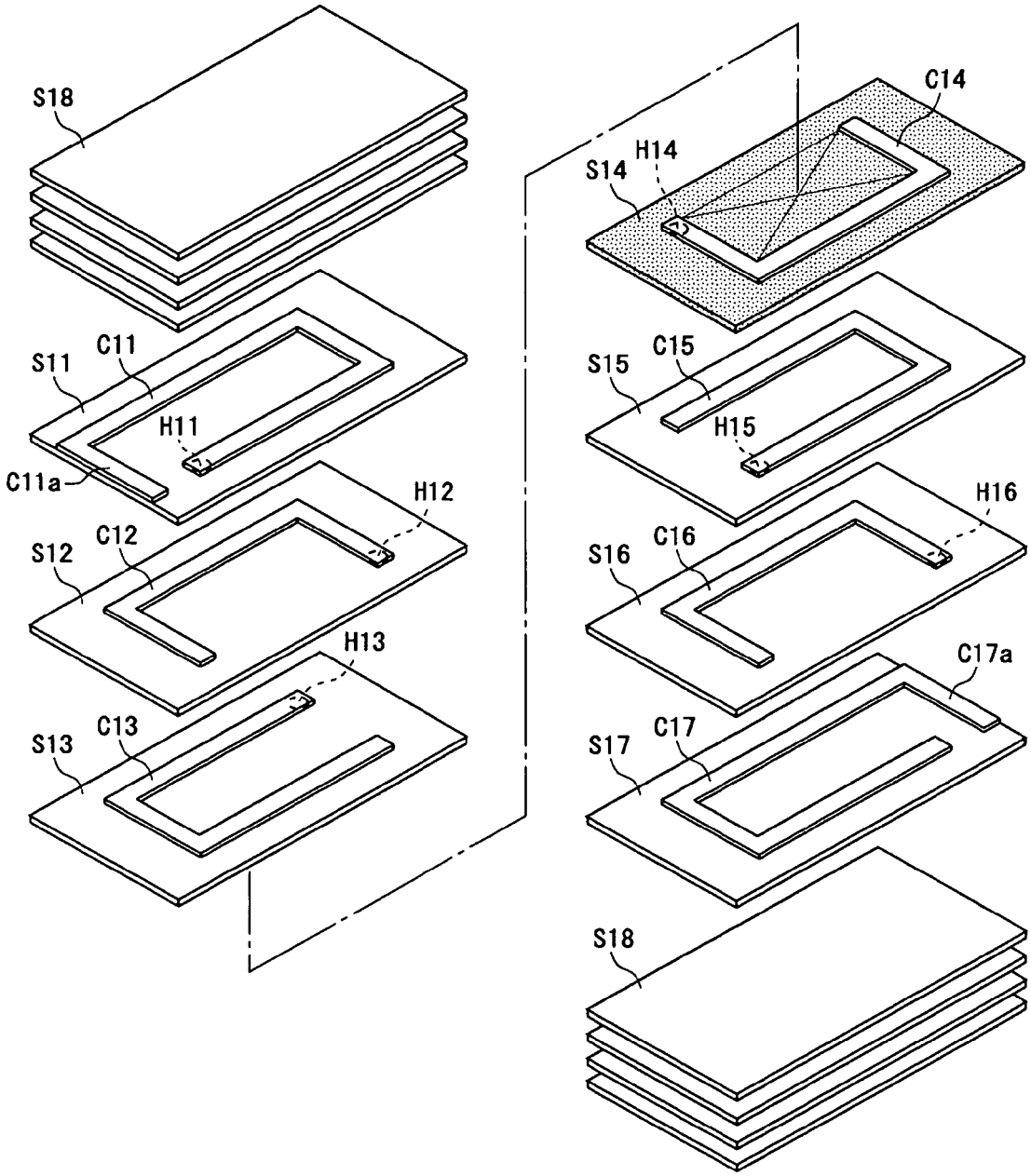
FIG. 4 is an exploded perspective view showing the laminated product shown in FIG. 1.
Figure 5:
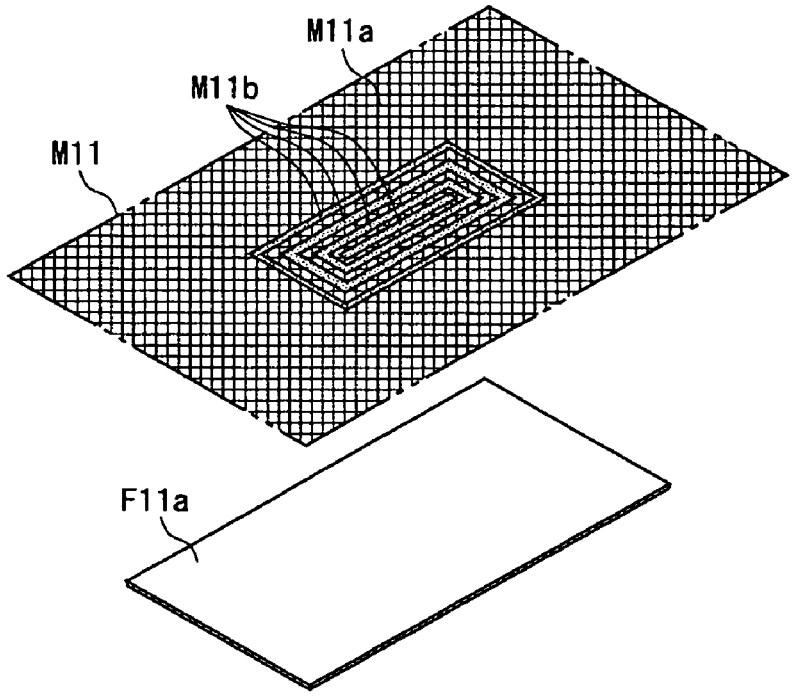
FIG. 5 is a partial perspective view showing a part of a process for manufacturing the multilayer inductor shown in FIG. 1.
Figure 6:
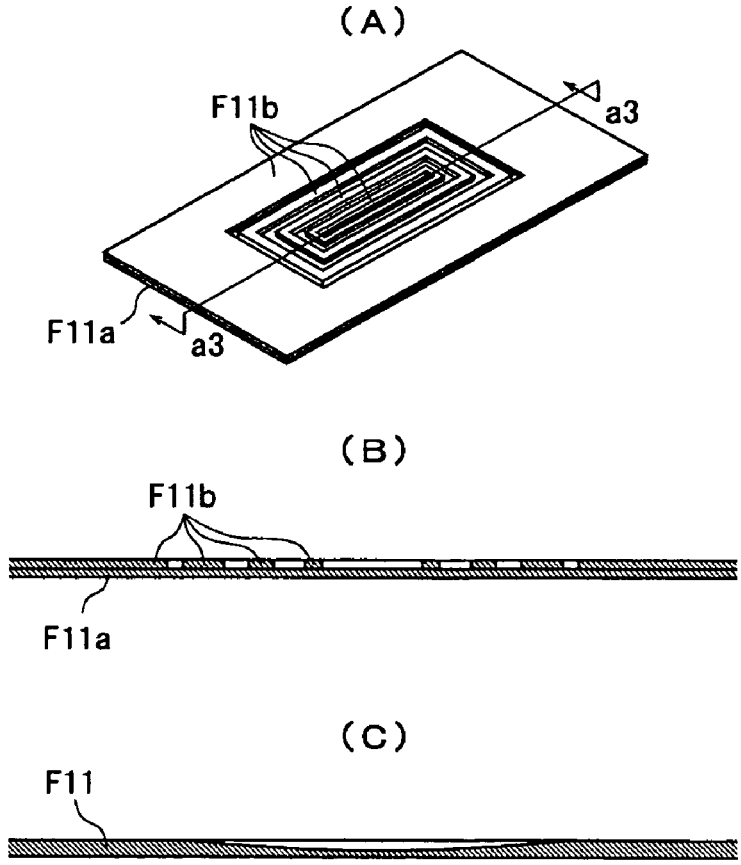
FIG. 6A is a partial perspective view showing a part of the process for manufacturing the multilayer inductor shown in FIG. 1.
FIG. 6B is a cross section showing the manufacturing process taken along the line a3-a3 shown in FIG. 6A.
FIG. 6C is a cross section showing the manufacturing process taken along the same line.
Figure 7:
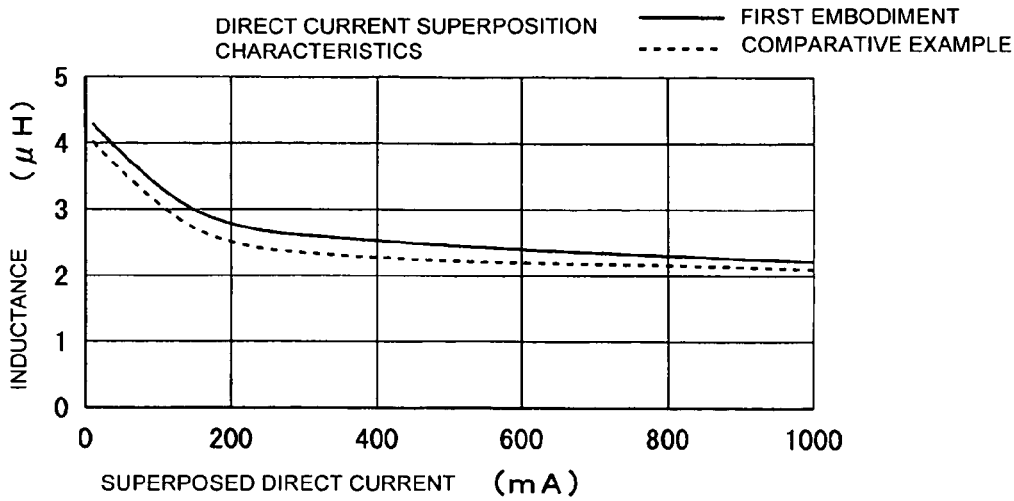
FIG. 7 is a graph showing direct current superposition characteristics of the multilayer inductor shown in FIG. 1.
Figure 8:
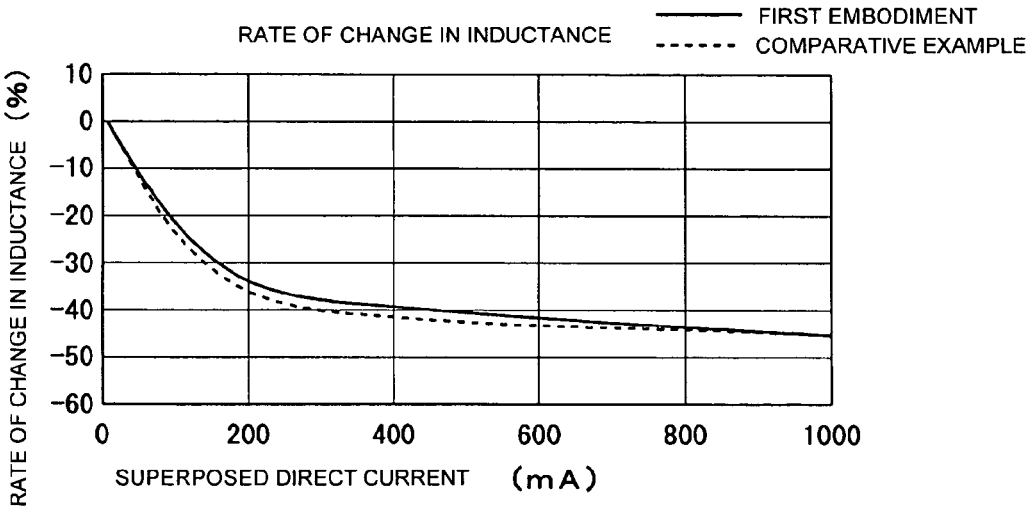
FIG. 8 is a graph showing a rate of change in inductance of the multilayer inductor shown in FIG. 1.
Figure 9:
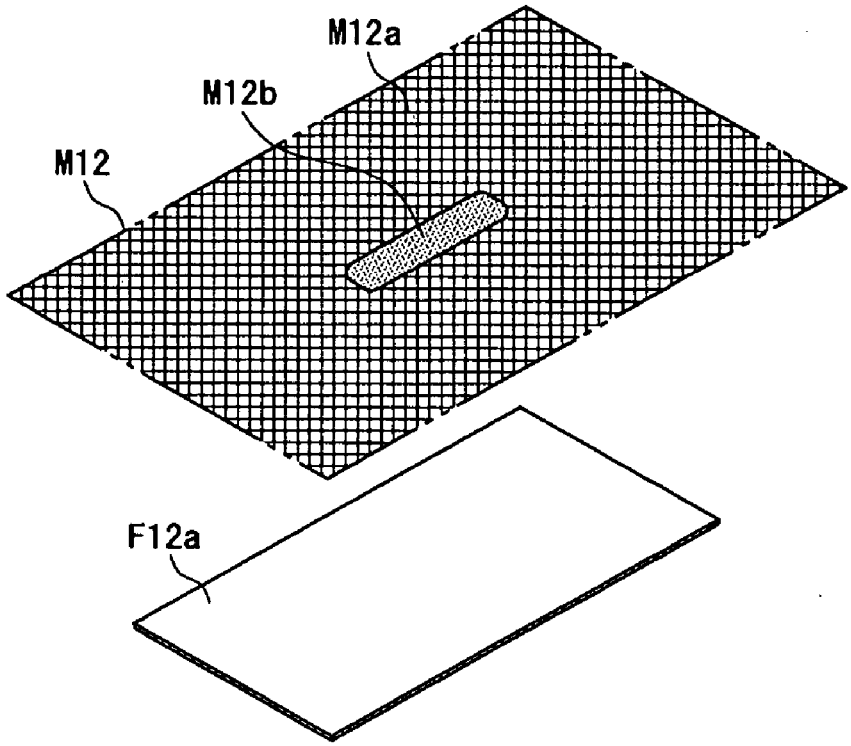
FIG. 9 is a partial perspective view showing a modification of the manufacturing process.
Figure 10:
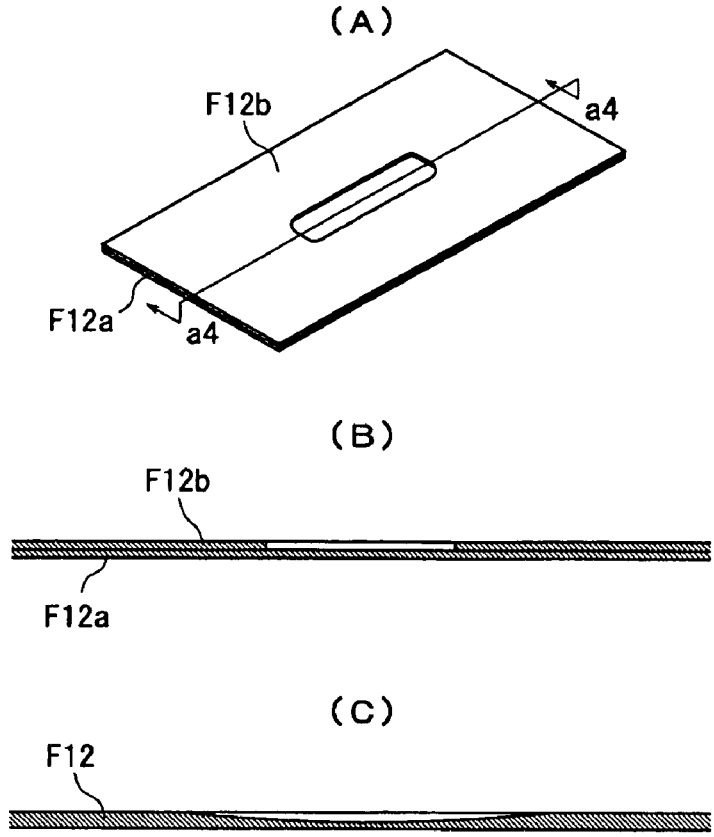
FIG. 10A is a partial perspective view showing the modification of the manufacturing process.
FIG. 10B is a cross section showing the modification taken along the line a4-a4 shown in FIG. 10A.
FIG. 10C is a cross section showing the modification taken along the same line.
Figure 11:
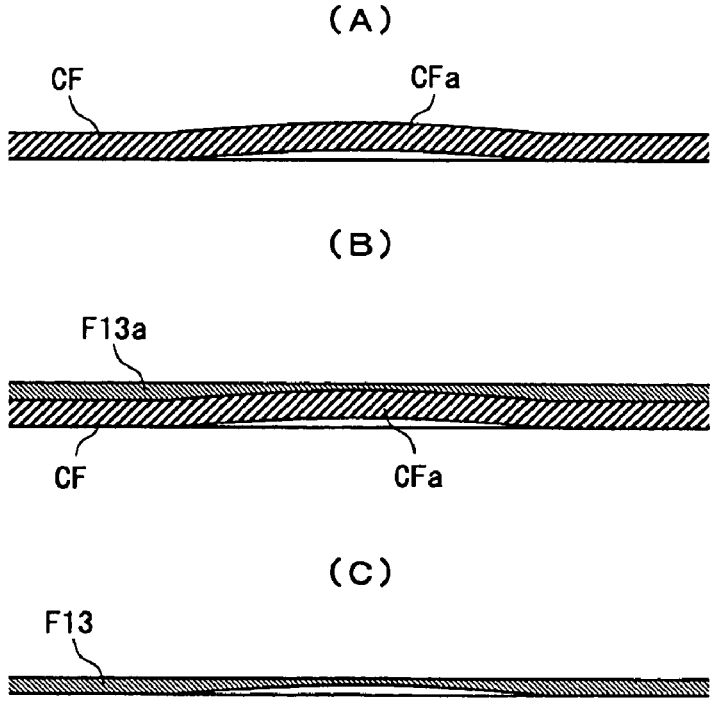
FIG. 11A is a cross section showing the other modification of the manufacturing process.
FIG. 11B is a cross section showing the other modification.
FIG. 11C is a cross section showing the other modification.

FIGS. 1 through 11 show a first embodiment of the present invention. FIG. 1 is a perspective view showing a multilayer inductor, FIG. 2 is a cross section taken along the line a1-a1 shown in FIG. 1, FIG. 3 is a cross section taken along the line a2-a2 shown in FIG. 1, FIG. 4 is an exploded perspective view showing the laminated product shown in FIG. 1, FIGS. 5 and 6A are partial perspective views showing a part of a process for manufacturing the multilayer inductor shown in FIG. 1, FIGS. 6B and 6C are cross sections taken along the line a3-a3 shown in FIG. 6A, FIG. 7 is a graph showing direct current superposition characteristics of the multilayer inductor shown in FIG. 1, FIG. 8 is a graph showing a rate of change in inductance of the multilayer inductor shown in FIG. 1, FIGS. 9 and 10A are partial perspective views showing a modification of the manufacturing process, FIGS. 10B and 10C are cross sections taken along the line a4-a4 shown in FIG. 10A, and FIGS. 11A to 11C are cross sections showing another modification of the manufacturing process.

First, a structure of a multilayer inductor 10 will be described with reference to FIGS. 1 to 3.

The multilayer inductor 10 includes a laminated product 11 being a rectangular parallelepiped, and the external electrodes 12 and 12 provided at both ends in the longitudinal direction of the laminated product 11 and made of metallic material such as Ag.

The laminated product 11 has a structure in which a plurality of conductor layers 1 a for forming a coil and a plurality of magnetic substance layers 11*b* are laminated alternately. A magnetic flux restrictor layer 11*c* is disposed at the center in the lamination direction of the laminated product 11 such that the magnetic flux restrictor layer 11*c* replaces one of the magnetic substance layers 11*b*.

Now, the layer structure of the laminated product 11 will be described with reference to FIG. 4. The laminated product 11 includes magnetic substance layers S11 to S13, and S15 to S18, made of Ni—Zn—Cu ferrite material or the like and having a high permeability; and a magnetic flux restrictor layer S14 made of Zn—Cu ferrite material or the like and having a permeability lower than that of the magnetic substance layers S11 to S13, and S15 to S18.

U-shaped coil conductor layers C11 to C13, and C15 to C17, made of metallic material such as Ag, are respectively disposed on the upper surfaces of the magnetic substance layers S11 to S13, and S15 to S17. In addition, through holes H11 to H13, H15 and H16 are respectively formed at the magnetic substance layers S11 to S13, S15 and S16 to respectively coincide with ends of the coil conductor layers C11 to C13, C15 and C16. Each of the through holes connects each upper and lower adjacent coil conductor layers to each other with the corresponding one of the magnetic substance layers S11 to S13, S15 and S16 interposed therebetween. Each of the through holes H11 to H13, H15 and H16 described here represents that a hole is previously made in the magnetic substance layer and then is filled with the same material as that of the coil conductor layer. The magnetic substance layers S18 provide upper and lower margins, and do not have the coil conductor or the through hole.

A U-shaped coil conductor layer C14 made of metallic material such as Ag is disposed on the upper surface of the magnetic flux restrictor layer S14. Also, a through hole H14 is formed at the magnetic flux restrictor layer S14 to coincide with an end of the coil conductor layer C14. The through hole H14 connects the upper and lower coil conductor layers to each other with the magnetic flux restrictor layer S14 interposed therebetween. The through hole H14 described here represents that a hole is previously made in the magnetic substance layer and then is filled with the same material as that of the coil conductor layer.

The coil conductor layers C11 to C17 are connected to each other via the through holes H11 to H16 to form a spiral coil. The uppermost coil conductor layer C11 and the lowermost coil conductor layer C17 for the coil are provided with lead-out portions C11*a* and C17*a*. One of the lead-out portions C11*a* and C17*a* is connected to one of the external electrodes 12 and 12, and the residual portion is connected to the residual electrode 12.

As shown in FIGS. 2 and 3, the magnetic flux restrictor layer 11*c* is formed such that a thickness at the center part of the coil (thin part TP) is smaller than a thickness at the vicinity of adjacently disposed one of the conductor layers. In particular, the thickness of the magnetic flux restrictor layer 11*c* in the inner region of the coil is gradually reduced toward the center part of the coil from the vicinity of the adjacent conductor layer. Providing an exemplary specific numerical value, in a case where the thickness of each magnetic substance layer 11*b* is about 15 μm, the thickness of the magnetic flux restrictor layer 11*c* at the vicinity of the adjacent conductor layer is about 15 μm, and the thickness of the thinnest part at the center part of the coil is about 10 μm.

Next, a process for manufacturing the multilayer inductor 10 will be described with reference to FIGS. 5, and 6A to 6C. Note that FIGS. 5, and 6A to 6C only show a part of the manufacturing process, corresponding to a single laminated product.

In manufacturing, first ferrite sheets (not shown) are produced to form the magnetic substance layers S11 to S13, and S15 to S18, made of Ni—Zn—Cu ferrite material or the like and having a high permeability.

Specifically, each first ferrite sheet is produced by adding ethyl cellulose and terpineol to ferrite powder which is mainly made of $FeO_2$, CuO, ZnO and NiO and prepared by calcining and crushing; mixing those materials to provide first ferrite paste; and processing the first ferrite paste to be a sheet by using a doctor blade or the like.

Also, a second ferrite sheet F11 (see FIG. 6C) is produced to form the magnetic flux restrictor layer S14 made of Zn—Cu ferrite material or the like and having a permeability lower than that of the magnetic substance layers S11 to S13, and S15 to S18.

Specifically, a base layer F11*a* (see FIG. 5) is provided by adding ethyl cellulose and terpineol to ferrite powder which is mainly made of $FeO_2$, CuO and ZnO and prepared by calcining and crushing; mixing those materials to provide second ferrite paste; and processing the second ferrite paste to be a sheet by using a doctor blade or the like. Then, the second ferrite paste is printed on one of the principal planes of the base layer F11*a* with the use of a screen printing mask M11 (see FIG. 5) to provide a predetermined print pattern F11*b* (see FIGS. 6A and 6B). The mask M11 has a plurality of coaxial annular mask patterns M11*b* in an area of a mesh M11*a* corresponding to the inner region of the coil. The annular mask patterns M11*b* inhibit the paste from passing through them. The print pattern F11*b* obtained by printing has a plurality of coaxial annular sections in an area corresponding to the inner region of the coil. A distance between the adjacent annular sections gradually increases toward the center part of the coil while an amount of the paste at the annular section gradually decreases (see FIGS. 6A and 6B). Then, the print pattern F11*b* is leveled due to its viscosity and fluidity, and integrated with the base layer F11*a*, thereby providing the second ferrite sheet F11 (see FIG. 6C). As shown in FIG. 6C, an area of the second ferrite sheet F11 corresponding to the inner region of the coil has a thickness which is gradually reduced toward the center part of the coil.

Then, the through holes are formed at the first ferrite sheets and the second ferrite sheet F11 according to predetermined arrangements by punching with a die, by boring with laser processing, or the like. After the through holes are formed, conductor paste is printed on the first ferrite sheets and the second ferrite sheet F11 by screen printing or the like according to predetermined patterns. For example, the conductor paste mentioned here is metal paste mainly consisting of Ag.

The first ferrite sheets with the conductor paste printed, and the second ferrite sheet F11 are laminated and pressed to provide the laminated product sheet so that the conductor paste patterns among the sheets are connected via the through holes to form a spiral coil. In this case, the first ferrite sheets and the second ferrite sheet F11 are laminated in the order to obtain the layer structure shown in FIG. 4.

Then, the laminated product sheet is cut into a laminated product with a unit size. The laminated product is heated for an hour at about 500° C. in the air to remove a binder component, and the binder-removed laminated product is baked for two hours at 800° C. to 900° C. in the air.

Then, conductor paste is applied to both ends of the baked laminated product by dipping or the like. For example, the conductor paste mentioned here is the above-described metal paste mainly consisting of Ag. After the conductor paste is applied, the laminated product is baked for an hour at about 600° C. in the air, whereby the external electrodes are provided. Then, the external electrodes are processed by plating.

Next, direct current superposition characteristics and a rate of change in inductance of the multilayer inductor 10 will be described with reference to FIGS. 7 and 8.

Figure 20:
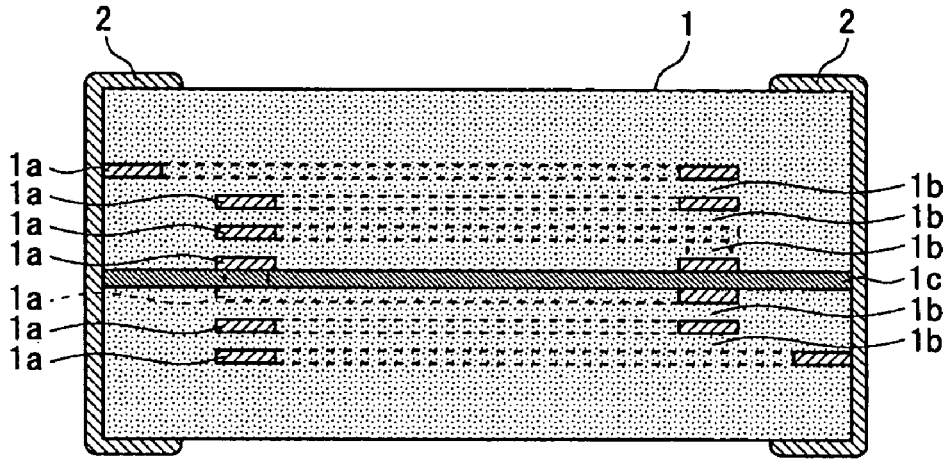
FIG. 20 PRIOR ART
FIG. 20 is a cross section showing a conventional multilayer inductor.

Note that a comparative example shown in FIGS. 7 and 8 corresponds to a multilayer inductor shown in FIG. 20. Each coil conductor layer 1*a* is made of metallic material such as Ag, each magnetic substance layer 1*b* is made of Ni—Zn—Cu ferrite material or the like, and a nonmagnetic insulator layer 1*c* is made of Zn—Cu ferrite material or the like. The nonmagnetic insulator layer 1*c* has a uniform thickness. In a case where the thickness of each magnetic substance layer 1*b* is about 15 μm, the thickness of the nonmagnetic insulator layer 1*c* at the vicinity of the adjacent conductor layer is about 15 μm, and the thickness thereof at the center part of the coil is also about 15 μm. A process for manufacturing the multilayer inductor according to the comparative example is the same as that of the multilayer inductor 10 except that a second ferrite sheet is produced to have the uniform thickness.

FIG. 7 is a graph in which the horizontal axis represents superposed direct current (mA) and the vertical axis represents an inductance (μH). Direct current superposition characteristics of the multilayer inductor 10 are indicated by a solid line, whereas that of the multilayer inductor according to the comparative example are indicated by a dotted line. As plotted in the graph, the direct current superposition characteristics of the multilayer inductor 10 is improved as compared with that of the multilayer inductor according to the comparative example in a 10 mA direct current region.

FIG. 8 is a graph in which the horizontal axis represents the superposed direct current (mA) and the vertical axis represents a rate of change in inductance (%). The direct current superposition characteristics of the multilayer inductor 10 are indicated by a solid line, whereas that of the multilayer inductor according to the comparative example are indicated by a dotted line. As plotted in the graph, the rate of change in inductance of the multilayer inductor 10 is improved as compared with that of the multilayer inductor according to the comparative example in the 10 mA direct current region.

According to the above-described multilayer inductor 10, increase in density of magnetic flux is suppressed by the magnetic flux restrictor layer 11*c* disposed to block the magnetic flux passing through the inner region of the coil, whereby magnetic saturation can be restricted when direct current is applied and thus the direct current superposition characteristics can be improved. In other words, a direct current value at which the inductance decreases due to the magnetic saturation can be shifted to a high value.

Additionally, the thickness of the magnetic flux restrictor layer 11*c* at the center part of the coil is smaller than the thickness thereof at the vicinity of the adjacently disposed one of the conductor layers, whereby the magnetic saturation can be suppressed at the vicinity of the conductor layers when the direct current is applied and besides magnetic reluctance at the center part of the coil can be decreased. Therefore, decrease in inductance due to the magnetic reluctance can be restricted and thus the direct current superposition characteristics and the rate of change in inductance can be further improved. In particular, the thickness of the magnetic flux restrictor layer 11*c* in the inner region of the coil is gradually reduced toward the center part of the coil from the vicinity of the adjacent conductor layer, whereby it is possible to secure distribution of the magnetic reluctance measuring up to density distribution of the magnetic flux passing through the inner region of the coil, thereby effectively suppressing the decrease in inductance.

Next, a modification of the above-described manufacturing process, i.e., a modification of the process for producing the second ferrite sheet will be described with reference to FIGS. 9, and 10A to 10C.

When producing a second ferrite sheet F12 (see FIG. 10C) to form the magnetic flux restrictor layer S14 made of Zn—Cu ferrite material or the like and having a permeability lower than that of the magnetic substance layers S11 to S13, and S15 to S18, a base layer F12*a* (see FIG. 9) is prepared by processing the above-described second ferrite paste, to be a sheet by using a doctor blade or the like. Then, the second ferrite paste is printed on one of the principal planes of the base layer F12*a* with the use of a screen printing mask M12 (see FIG. 9) to provide a predetermined print pattern F12*b* (see FIGS. 10A and 10B). The mask M12 has a substantially ellipsoidal mask pattern M12*b* at the center part of a mesh M12*a* in an area corresponding to the inner region of the coil. The mask pattern M12*b* inhibits the paste from passing through it. The print pattern F12*b* obtained by printing has a substantially ellipsoidal hole at the center part of an area corresponding to the inner region of the coil (see FIGS. 10A and 10B). Then, the print pattern F12*b* is leveled due to its viscosity and fluidity, and integrated with the base layer F12*a*, thereby providing the second ferrite sheet F12 (see FIG. 10C). As shown in FIG. 10C, an area of the second ferrite sheet F12 corresponding to the inner region of the coil has a thickness which is gradually reduced toward the center part of the coil.

Next, another modification of the above-described manufacturing process, i.e., another modification of the process for producing the second ferrite sheet will be described with reference to FIGS. 11A to 11C.

When producing a second ferrite sheet F13 (see FIG. 11C) to form the magnetic flux restrictor layer S14 made of Zn—Cu ferrite material or the like and having a permeability lower than that of the magnetic substance layers S11 to S13, and S15 to S18, a carrier film CF made of polyethylene terephthalate (PET) or the like is prepared (see FIG. 11A). The carrier film CF has a curved portion CFa in an area corresponding to the inner region of the coil. The curved portion CFa is curved upward in the thickness direction. Then, the carrier film CF is coated with the above-described second ferrite paste by using a doctor blade or the like (see FIG. 11B). A coated ferrite paste F13*a* is dried, and then the carrier film CF is removed to provide the second ferrite sheet F13 (see FIG. 11C). As shown in FIG. 11C, an area of the second ferrite sheet F13 corresponding to the inner region of the coil has a thickness which is gradually reduced toward the center part of the coil.

In the given description, the single magnetic flux restrictor layer 11*c* is provided in the laminated product 11. However, the same advantages can be attained even if two or more magnetic flux restrictor layers 11*c* are provided adjacently in the lamination direction, or with a space interposed therebetween in the lamination direction.

Figure 12:
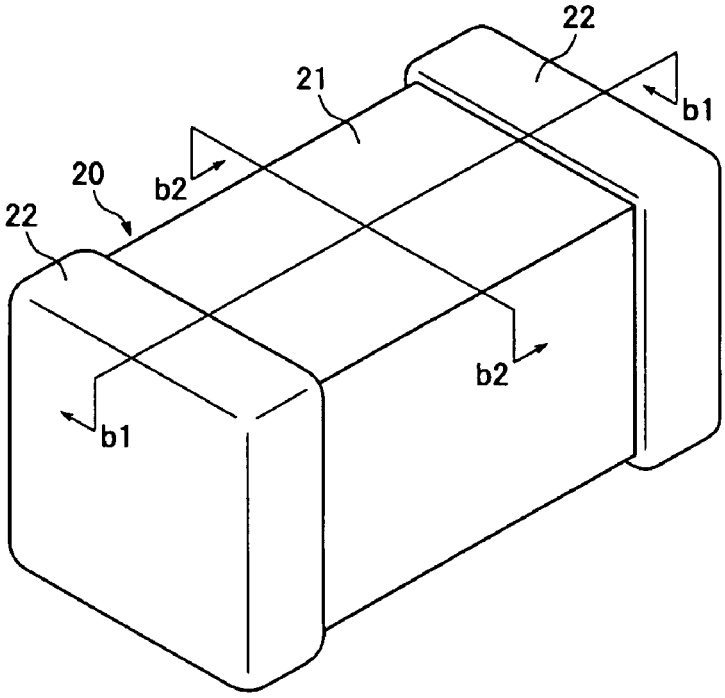
FIG. 12 is a perspective view showing a multilayer inductor according to a second embodiment of the present invention.
Figure 13:
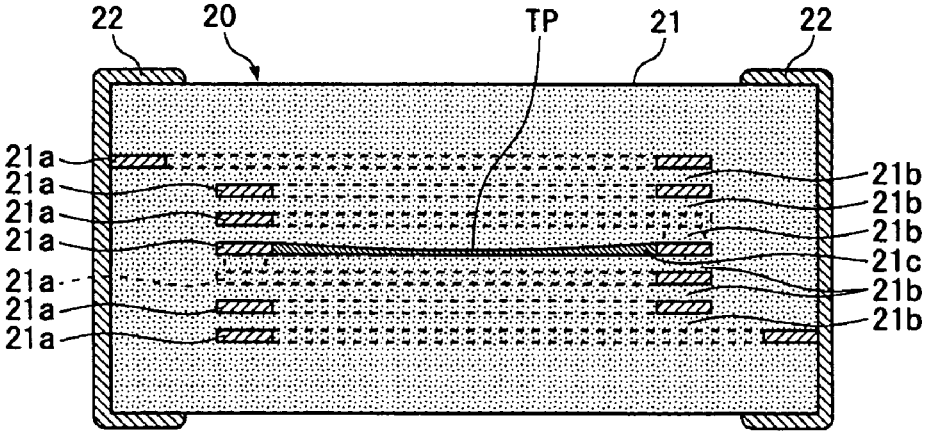
FIG. 13 is a cross section taken along the line b1-b1 shown in FIG. 12.
Figure 14:
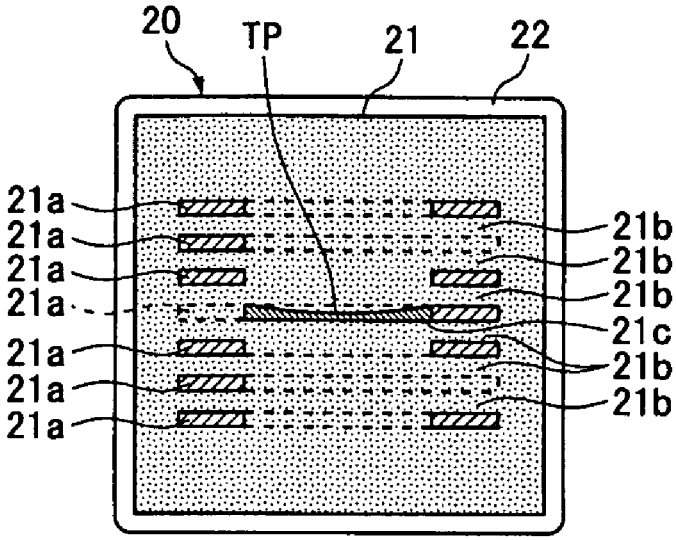
FIG. 14 is a cross section taken along the line b2-b2 shown in FIG. 12.
Figure 15:
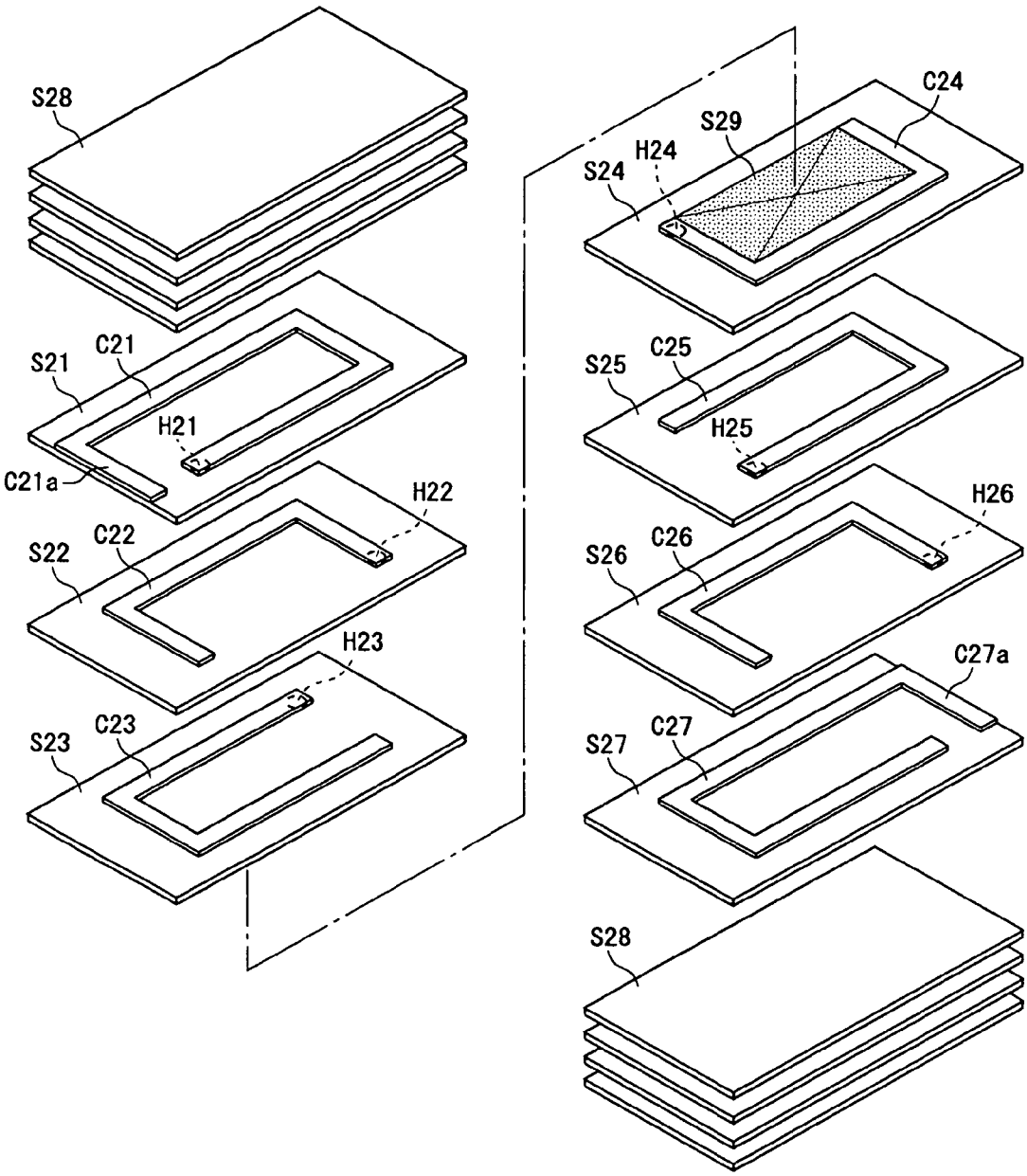
FIG. 15 is an exploded perspective view showing the laminated product shown in FIG. 12.
Figure 16:
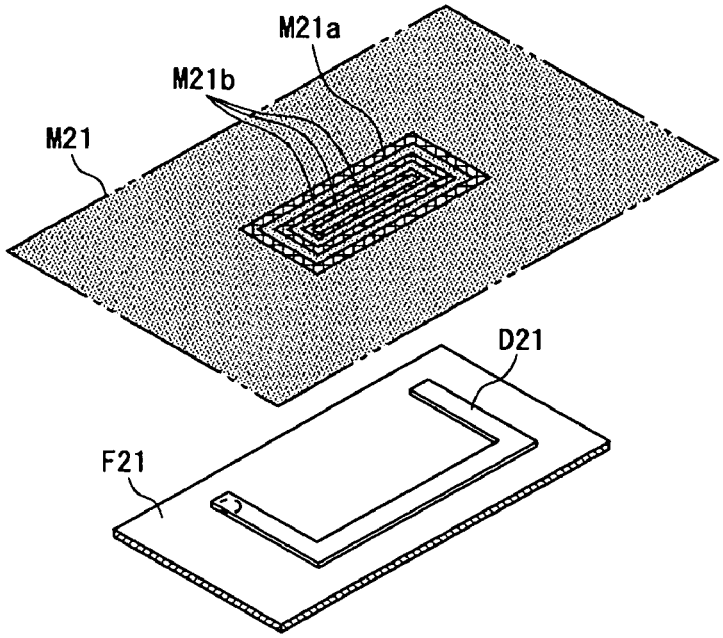
FIG. 16 is a partial perspective view showing a part of a process for manufacturing the multilayer inductor shown in FIG. 12.
Figure 17:
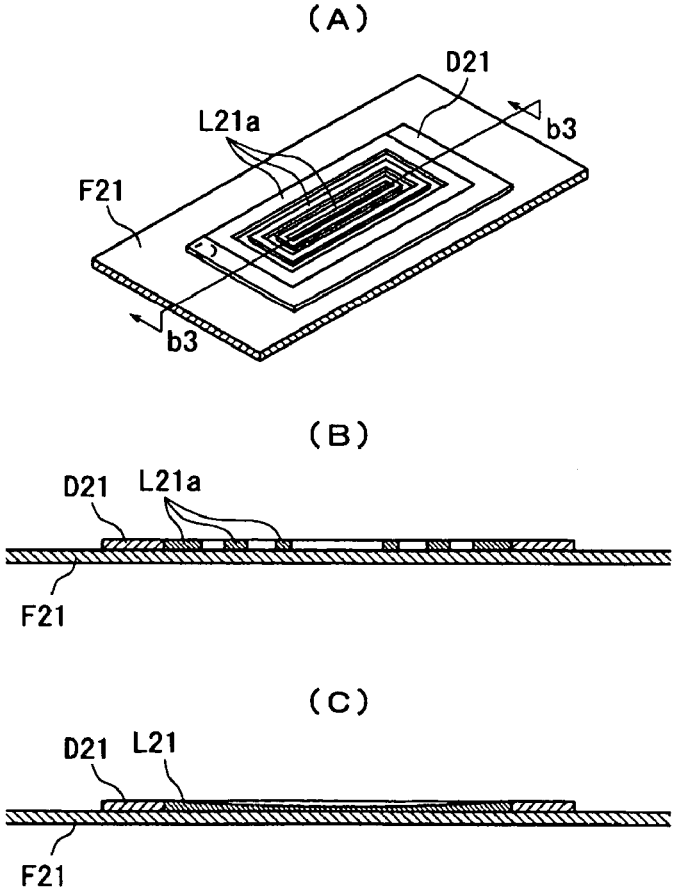
FIG. 17A is a partial perspective view showing a part of the process for manufacturing the multilayer inductor shown in FIG. 12.
FIG. 17B is a cross section showing the manufacturing process taken along the line b3-b3 shown in FIG. 17A.
FIG. 17C is a cross section showing the manufacturing process taken along the same line.
Figure 18:
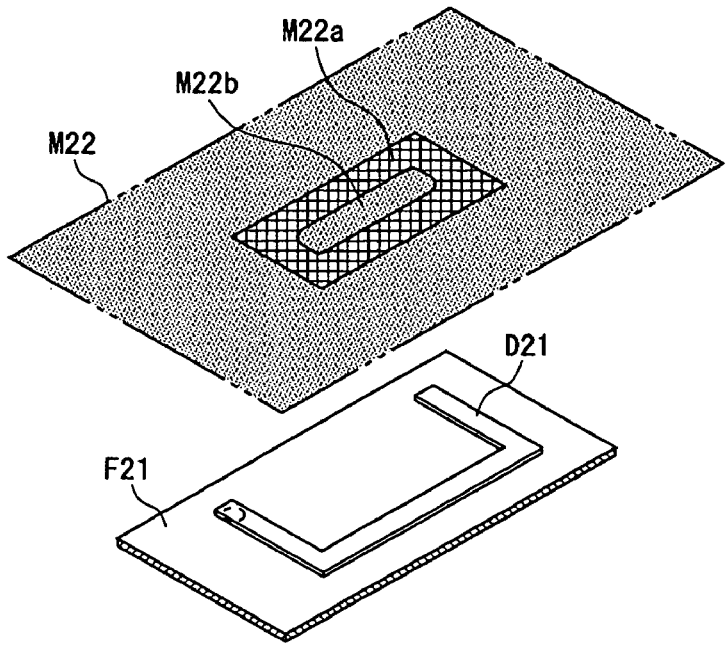
FIG. 18 is a partial perspective view showing a modification of the manufacturing process.
Figure 19:
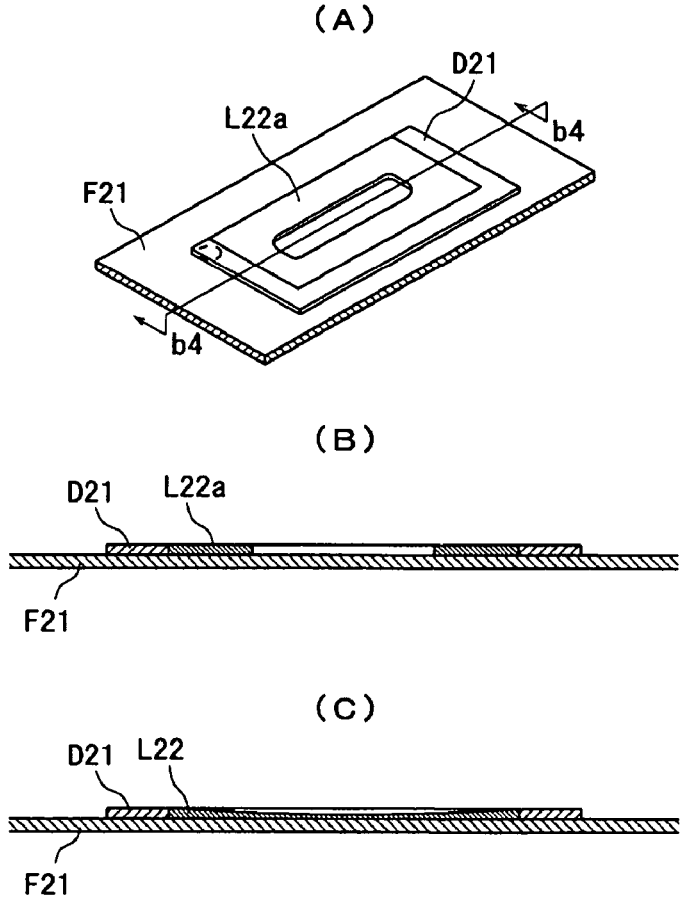
FIG. 19A is a partial perspective view showing the modification of the manufacturing process.
FIG. 19B is a cross section showing the modification taken along the line b4-b4 shown in FIG. 19A.
FIG. 19C is a cross section showing the modification taken along the same line.

FIGS. 12 through 17 show a second embodiment of the present invention. FIG. 12 is a perspective view showing a multilayer inductor, FIG. 13 is a cross section taken along the line b1-b1 shown in FIG. 12, FIG. 14 is a cross section taken along the line b2-b2 shown in FIG. 12, FIG. 15 is an exploded perspective view showing the laminated product shown in FIG. 12, FIGS. 16 and 17A are partial perspective views showing a part of a process for manufacturing the multilayer inductor shown in FIG. 12, FIGS. 17B and 17C are cross sections taken along the line b3-b3 shown in FIG. 17A, FIGS. 18 and 19A are partial perspective views showing a modification of the manufacturing process, and FIGS. 19B and 19C are cross sections taken along the line b4-b4 shown in FIG. 19A.

First, a structure of a multilayer inductor 20 will be described with reference to FIGS. 12 to 14.

The multilayer inductor 20 includes a laminated product 21 being a rectangular parallelepiped, and external electrodes 22 and 22 provided at both ends in the longitudinal direction of the laminated product 21 and made of metallic material such as Ag.

The laminated product 21 has a structure in which a plurality of conductor layers 21*a* for forming a coil and a plurality of magnetic substance layers 21*b* are laminated alternately. A magnetic flux restrictor layer 21*c* is disposed at the center in the lamination direction of the laminated product 21 and in a region surrounded by the conductor layer 21*a* so as to have the equivalent shape as that of the region surrounded by the conductor layer 21*a*.

Now, the layer structure of the laminated product 21 will be described with reference to FIG. 15. The laminated product 21 includes magnetic substance layers S21 to S28 made of Ni—Zn—Cu ferrite material or the like and having a high permeability; and a magnetic flux restrictor layer S29 made of Zn—Cu ferrite material or the like and having a permeability lower than that of the magnetic substance layers S21 to S28.

U-shaped coil conductor layers C21 to C27 made of metallic material such as Ag are respectively disposed on the upper surfaces of the magnetic substance layers S21 to S27. In addition, through holes H21 to H26 are respectively formed at the magnetic substance layers S21 to S26 to respectively coincide with ends of the coil conductor layers C21 to C26. Each of the through holes connects each upper and lower adjacent coil conductor layers to each other with the corresponding one of the magnetic substance layers S21 to S26 interposed therebetween. Each of the through holes H21 to H26 described here represents that a hole is previously made in the magnetic substance layer and then is filled with the same material as that of the coil conductor layer. The magnetic substance layers S28 provide upper and lower margins, and do not have the coil conductor or the through hole.

The magnetic flux restrictor layer S29 is disposed in the region surrounded by the coil conductor layer C24 disposed on the upper surface of the magnetic substance layer S24. The shape of the magnetic flux restrictor layer S29 is equivalent to that of the region surrounded by the coil conductor layer C24, and the maximum thickness of the magnetic flux restrictor layer S29 is equal to a thickness of the coil conductor layer C24.

The coil conductor layers C21 to C27 are connected to each other via the through holes H21 to H26 to form a spiral coil. The uppermost coil conductor layer C21 and the lowermost coil conductor layer C27 for the coil are provided with lead-out portions C21 a and C27*a*. One of the lead-out portions C21*a* and C27*a* is connected to one of the external electrodes 22 and 22, and the residual portion is connected to the residual electrode 22.

As shown in FIGS. 13 and 14, the magnetic flux restrictor layer 21*c* is formed such that a thickness at the center part of the coil (thin part TP) is smaller than a thickness at the vicinity of adjacently disposed one of the conductor layers. In particular, the thickness of the magnetic flux restrictor layer 21*c* is gradually reduced toward the center part of the coil from the vicinity of the adjacent conductor layer. Providing an exemplary specific numerical value, in a case where the thickness of each conductor layer 21*a* is about 15 μm, the thickness of the magnetic flux restrictor layer 21*c* at the vicinity of the adjacent conductor layer is about 15 μm, and the thickness of the thinnest part at the center part of the coil is about 10 μm.

Next, a process for manufacturing the multilayer inductor 20 will be described with reference to FIGS. 16, and 17A to 17C. Note that FIGS. 16, and 17A to 17C only show a part of the manufacturing process, corresponding to a single laminated product.

In manufacturing, first ferrite sheets (not shown) are produced to form the magnetic substance layers S21 to S28 made of Ni—Zn—Cu ferrite material or the like and having a high permeability.

Specifically, each first ferrite sheet is produced by adding ethyl cellulose and terpineol to ferrite powder which is mainly made of $FeO_2$, CuO, ZnO and NiO and prepared by calcining and crushing; mixing those materials to provide first ferrite paste; and processing the first ferrite paste to be a sheet by using a doctor blade or the like.

Then, the through holes are formed at the ferrite sheets according to predetermined arrangements by punching with a die, by boring with laser processing, or the like. After the through holes are formed, conductor paste is printed on the ferrite sheets by screen printing or the like according to predetermined patterns. For example, the conductor paste mentioned here is metal paste mainly consisting of Ag.

Then, a ferrite layer L21 (see FIG. 17C) is formed in the region surrounded by a conductor paste pattern D21 provided on the ferrite sheet F21, which is one of the ferrite sheets, for forming the magnetic substance layer S24. The ferrite layer L21 forms the magnetic flux restrictor layer S29 made of Zn—Cu ferrite material or the like and having a permeability lower than that of the magnetic substance layers S21 to S28.

Specifically, a predetermined print pattern L21*a* (see FIGS. 17A and 17B) is provided by adding ethyl cellulose and terpineol to ferrite powder which is mainly made of $FeO_2$, CuO and ZnO and prepared by calcining and crushing; mixing those materials to provide second ferrite paste; and printing the second ferrite paste on the ferrite sheet F21 in the region surrounded by the conductor paste pattern D21 with the use of a screen printing mask M21 (see FIG. 16). The mask M21 has a plurality of coaxial annular mask patterns M21*b* in an area of a mesh M21*a* corresponding to the inner region of the coil. The mask M21 also has a mask pattern (no reference numeral given) in the outer region of the coil to inhibit the paste from passing through it. The print pattern L21*a* obtained by printing has a plurality of coaxial annular sections in the region surrounded by the conductor paste pattern D21. A distance between the adjacent annular sections gradually increases toward the center part of the coil while an amount of the paste at the annular section gradually decreases (see FIGS. 17A and 17B). Then, the print pattern L21*a* is leveled due to its viscosity and fluidity, thereby providing the ferrite layer L21 (see FIG. 17C). As shown in FIG. 17C, a thickness of the ferrite layer L21 is gradually reduced toward the center part of the coil from the vicinity of the adjacent conductor layer.

The ferrite sheet F21 provided with the ferrite layer, and the residual ferrite sheets are laminated and pressed to provide the laminated product sheet so that the conductor paste patterns among the sheets are connected via the through holes to form a spiral coil. In this case, the ferrite sheet F21 provided with the ferrite layer, and the residual ferrite sheets are laminated in the order to obtain the layer structure shown in FIG. 15.

Then, the laminated product sheet is cut into a laminated product with a unit size. The laminated product is heated for an hour at about 500° C. in the air to remove a binder component, and the binder-removed laminated product is baked for two hours at 800° C. to 900° C. in the air.

Then, conductor paste is applied to both ends of the baked laminated product by dipping or the like. For example, the conductor paste mentioned here is the above-described metal paste mainly consisting of Ag. After the conductor paste is applied, the laminated product is baked for an hour at about 600° C. in the air, whereby the external electrodes are provided. Then, the external electrodes are processed by plating.

According to the above-described multilayer inductor 20, increase in density of magnetic flux is suppressed by the magnetic flux restrictor layer 21*c* disposed to block the magnetic flux passing through the inner region of the coil, whereby magnetic saturation can be restricted when direct current is applied and thus the direct current superposition characteristics can be improved. In other words, a direct current value at which the inductance decreases due to the magnetic saturation can be shifted to a high value.

Additionally, the thickness of the magnetic flux restrictor layer 21*c* at the center part of the coil is smaller than the thickness thereof at the vicinity of the adjacently disposed one of the conductor layers, whereby the magnetic saturation can be suppressed at the vicinity of the conductor layers when the direct current is applied, and besides magnetic reluctance at the center part of the coil can be decreased. Therefore, decrease in inductance due to the magnetic reluctance can be restricted and thus the direct current superposition characteristics and the rate of change in inductance can be further improved. In particular, the thickness of the magnetic flux restrictor layer 21*c* is gradually reduced toward the center part of the coil from the vicinity of the adjacent conductor layer, whereby it is possible to secure distribution of the magnetic reluctance measuring up to density distribution of the magnetic flux passing through the inner region of the coil, thereby effectively suppressing the decrease in inductance.

Next, a modification of the above-described manufacturing process, i.e., a modification of the process for producing the ferrite layer will be described with reference to FIGS. 18, and 19A to 19C.

When producing a ferrite layer L22 (see FIG. 19C) to form the magnetic flux restrictor layer S29 made of Zn—Cu ferrite material or the like and having a permeability lower than that of the magnetic substance layers S21 to S28, a predetermined print pattern L22*a* (see FIGS. 19A and 19B) is provided by printing the above-described second ferrite paste on the ferrite sheet F21 in the region surrounded by the conductor paste pattern D21 with the use of a screen printing mask M22 (see FIG. 18). The mask M22 has a substantially ellipsoidal mask pattern M22*b* at the center of an area of a mesh M22*a* corresponding to the inner region of the coil. The mask M22 also has a mask pattern (no reference numeral given) in an area corresponding to the outer region of the coil to inhibit the paste from passing through it. The print pattern L22*a* obtained by printing is located in the region surrounded by the conductor paste pattern D21 and has a substantially ellipsoidal hole at the center part thereof (see FIGS. 19A and 19B). Then, the print pattern L22*a* is leveled due to its viscosity and fluidity, thereby providing the ferrite layer L22 (see FIG. 19C). As shown in FIG. 19C, a thickness of the ferrite layer L22 is gradually reduced toward the center part of the coil from the vicinity of the adjacent conductor layer.

In the given description, the single magnetic flux restrictor layer 21*c* is provided in the laminated product 21. However, the same advantages can be attained when two or more magnetic flux restrictor layers 21*c* are provided adjacently in the lamination direction, or with a space interposed therebetween in the lamination direction.

While the above detailed description has shown, described, and pointed out novel features of the invention as applied to various embodiments, it will be understood that various omissions, substitutions, and changes in the form and details of the device or process illustrated may be made by those skilled in the technology without departing from the spirit of the invention. The scope of the invention is indicated by the appended claims rather than by the foregoing description. All changes which come within the meaning and range of equivalency of the claims are to be embraced within their scope.

What is claimed is:

1. A multilayer inductor comprising:

a plurality of conductor layers for a coil;

a plurality of magnetic substance layers, the magnetic substance layers and the conductor layers laminated alternately; and at least one magnetic flux restrictor layer disposed to block magnetic flux passing through the inner region of the coil, wherein the magnetic flux restrictor layer is thinner at the center part of the coil than it is in a region near one of the conductor layers.

2. The multilayer inductor according to claim 1, wherein the thickness of the magnetic flux restrictor layer is gradually reduced toward the center part of the coil from the region near an adjacent conductor layer.

3. The multilayer inductor according to claim 1, wherein the magnetic flux restrictor layer is disposed such that the magnetic flux restrictor layer replaces at least one of the magnetic substance layers.

4. The multilayer inductor according to claim 1, wherein the magnetic flux restrictor layer is disposed in a region surrounded by at least one of the conductor layers.

5. The multilayer inductor according to claim 1, wherein the magnetic flux restrictor layer has a permeability lower than the magnetic substance layers.

6. The multilayer inductor according to claim 1, wherein the magnetic flux restrictor layer comprises Zn—Cu ferrite material.

* * * * *

UNITED STATES PATENT AND TRADEMARK OFFICE

CERTIFICATE OF CORRECTION

PATENT NO. : 7,446,638 B2
APPLICATION NO. : 11/633241
DATED : November 4, 2008
INVENTOR(S) : Kenichirou Nogi It is certified that error appears in the above-identified patent and that said Letters Patent is hereby corrected as shown below:

At Column 3, Line 30, please delete "1 a" and insert therefore, --11a--.

Signed and Sealed this

Fourth Day of August, 2009

JOHN DOLL
*Acting Director of the United States Patent and Trademark Office*